US008047891B1

(12) United States Patent
Albritton

(10) Patent No.: US 8,047,891 B1
(45) Date of Patent: Nov. 1, 2011

(54) NIKITA BRA

(76) Inventor: Nikita Albritton, Mitchellville, MD (US)

( * ) Notice: Subject to any disclaimer, the term of this patent is extended or adjusted under 35 U.S.C. 154(b) by 0 days.

(21) Appl. No.: 12/073,574

(22) Filed: May 16, 2008

Related U.S. Application Data

(60) Provisional application No. 61/006,525, filed on Jan. 18, 2008.

(51) Int. Cl.
*A41C 3/00* (2006.01)

(52) U.S. Cl. ..... 450/38; 450/57

(58) Field of Classification Search ..... 450/38, 450/54–58; 2/267, 268, DIG. 3, 67, 1; 607/7, 607/8
See application file for complete search history.

(56) References Cited

U.S. PATENT DOCUMENTS 5,833,515 A * 11/1998 Shahbazian et al. ..... 450/38
6,080,037 A * 6/2000 Lee et al. ..... 450/38
6,302,760 B1 * 10/2001 Dai ..... 450/38
6,461,221 B1 * 10/2002 Stilwell et al. ..... 450/57

* cited by examiner

*Primary Examiner* — Gloria Hale

(57) ABSTRACT

A brassiere for women who need or desire breast enhancement manufactured with internal air bags or the like which can provide apparent enhancement without the need for surgery, or for use after surgical loss of breast tissue. The brassiere can be used either by women who have had surgical removal of a breast or by women who desire breast enlargement.

4 Claims, 3 Drawing Sheets

NIKITA BRA

CROSS REFERENCE TO RELATED APPLICATIONS

This application claims priority to U.S. Provisional Application No. 61/006,525, filed Jan. 18, 2008. The contents of Provisional Application No. 60/936,018 are incorporated by reference, including all text and drawings.

BACKGROUND

1. Field of the Invention

This invention relates to a prosthetic brassiere.

2. Background of the Invention

Women who suffer surgical loss of breast tissue for treatment of cancer, because of injury or other conditions have a variety of permanent or temporary clothing options to restore their appearance and to match the appearance of the non-affected side. U.S. Pat. No. 3,934,274 describes a prosthesis which is surgically implanted and filled with fluid or liquid and U.S. Pat. No. 4,178,643 describes a valve which may be used to either fill or withdraw fluids or gels from a surgically-implanted prosthesis. U.S. Pat. No. 4,734,078 describes a brassiere having a liquid reservoir chamber and U.S. Pat. No. 7,144,296 discloses a strapless fluid-filled breast enhancement system to be worn by adhesive attachment to the wearer's skin. U.S. Pat. Nos. 6,302,760; 6,461,221; and 6,811,463 all describe brassieres with air inflatable chambers. The '760 patent discloses a brassiere with which air bladder can be symmetrically filled or depleted of air and requiring the use of a blast air pump. The '221 patent directs the airflow to only the lower portion of the bra, whereas the '463 patent describes a brassiere comprising non-fillable air bladder pads throughout the brassiere material. There exists a need to have such clothing available that is both easy to use and easily adjustable by the wearer.

SUMMARY OF THE INVENTION

The present invention is drawn to a piece of clothing commonly known as a bra, for women who need breast enhancement. The brassiere of the invention comprises air bags or the like which can provide apparent enhancement without the need for surgery, or for use after surgical loss of breast tissue.

DETAILED DESCRIPTION OF THE INVENTION

The present invention is drawn to a piece of clothing commonly known as a brassiere or similar to the top of a two-piece women's bathing suit, for women who need breast enhancement. The brassiere of the invention comprises air bags or the like which can provide apparent enhancement without the need for surgery. The invention also eliminates physical defects caused by surgery and the pain and healing afterwards, or other defects and leakage caused by surgical breast implants.

Nearly 200,000 women per year are diagnosed with breast cancer (National Cancer Society) and many chose to undergo mastectomy to increase their chances of surviving the disease. The brassiere of the invention was conceived to provide another after care option to aid women to perhaps be used as a pre-operative measure while awaiting breast reconstruction surgery; or as a permanent lightweight prosthetics for women who chose not to undergo breast reconstruction. The brassiere of the invention will allow women who would still like to fit into their clothes without being encumbered by current technology which is often restrictive, heavy, and irritating. The current invention will also allow cancer survivors to avoid any embarrassment they may feel by the change in their appearance after surgery. The invention may also be used by any woman who wishes to augment the size of her bust line or to fit better into stylish clothing.

Figure 1:
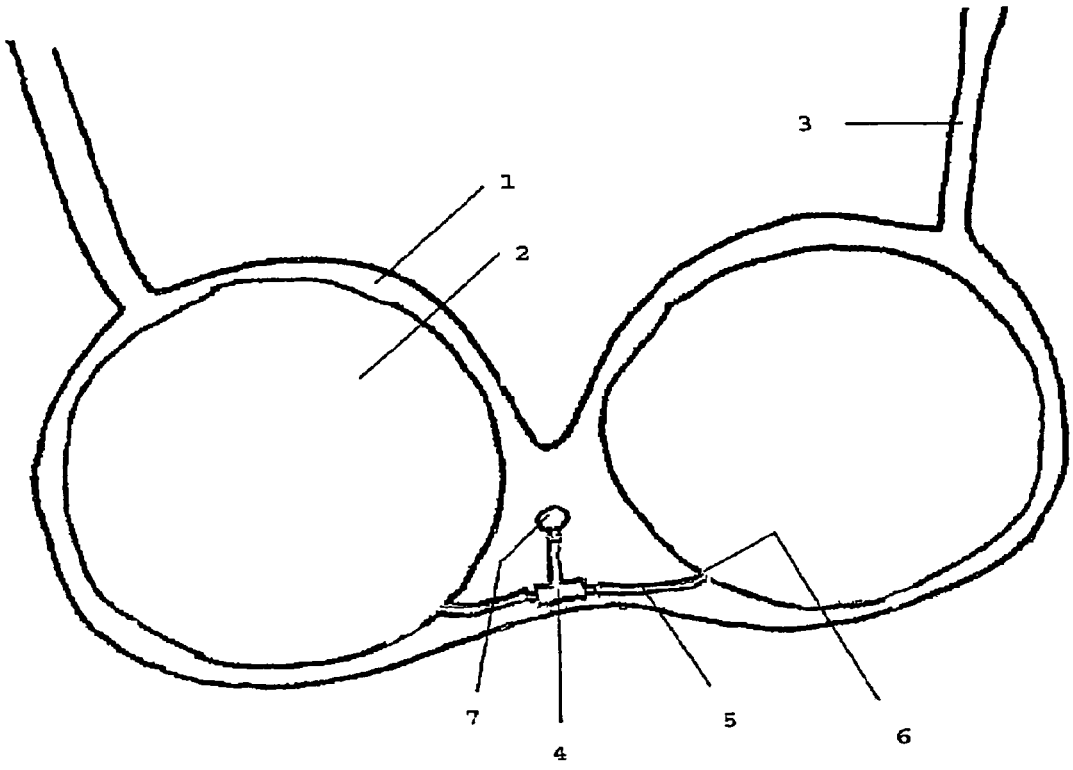
FIG. 1 depicts a front view of the brassiere.

FIG. 1 depicts an embodiment of the brassiere 1 of the invention. A flexible or stretch lightweight material forms the body of the brassiere 1 and appears quite similar to conventional brassieres. An air bladder or air bag 2 is present either bilaterally or on a preferred side, especially for use after mastectomy or to correct a congenital defect. A pump 7 is optionally located in the center of the brassiere allows for wearer activated inflation of the air bladder. The pump 7 is attached to a t-tube 4 in a bilateral embodiment to allow the air or gas to inflate both sides symmetrically through the tubing 5 which is attached to a oneway valve or opening 6 into the bladder. The tubing 5 on one side or the other may be optionally blocked by the wearer for single-sided inflation. The pump 7 may be a ball pump or other manual pumps commonly used in inflation mechanisms. The bladder 2 of the invention is made to appear in size and shape to a normal female human breast, however, any shape of the bladder may be used as needed by the wearer. Straps 3 are optional on the brassiere and may be manufactured from any common material used in brassiere products. The air bladder, valves, pump and tubing comprise the "air bladder assembly," as used herein.

Figure 2:
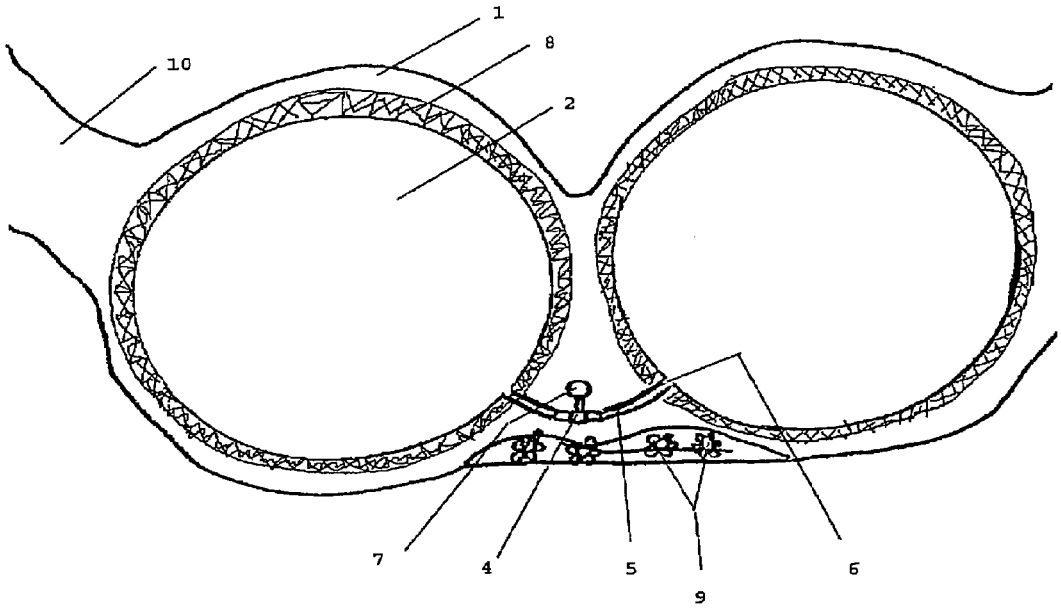
FIG. 2 shows a front view of a strapless embodiment of the brassiere.

FIG. 2 shows a frontal view of the brassiere of the invention and shows a strapless embodiment of the invention, and the strap that goes around the wearer's torso 10. FIG. 2 also shows a plate 8 located behind the air bag and closest to the body of the wearer such that the airbag will inflate away from the wearer. The plate may be manufactured from any suitable material and may be pliable, semi-rigid or rigid and may be "breathable" for moisture control. The plate may optionally be pre-molded to fit the wearer, said molding may be custom-fitted to the wearer. Knobs or buttons 9 are depicted which allows the wearer to discharge air from the air bladder.

Figure 3:
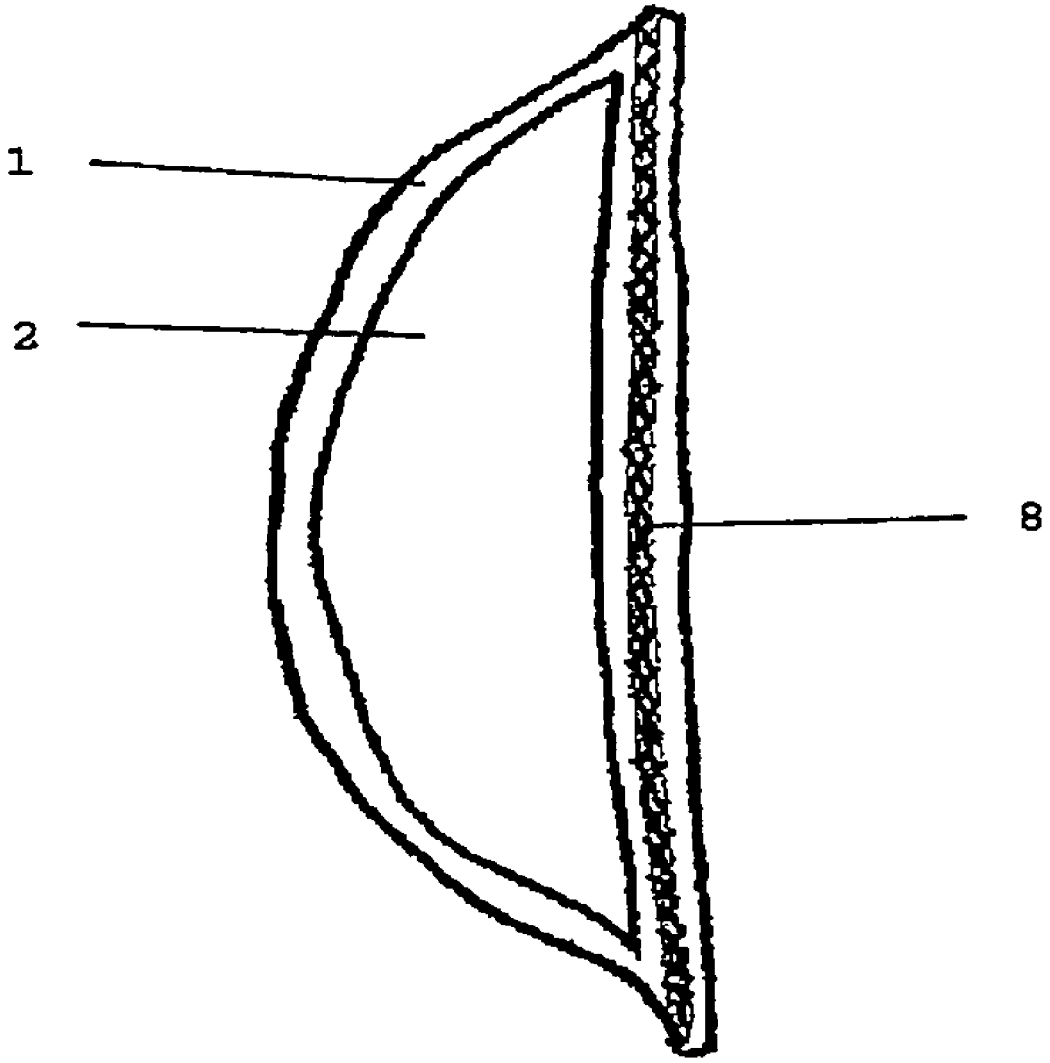
FIG. 3 depicts a side view of the brassiere.

FIG. 3 is a side view of one side of the brassiere, corresponding to a "cup" in a conventional brassiere. The side view shows the plate 8 located behind the air bladder 2 and all incorporated into the fabric of the brassiere.

The brassiere of the invention may be manufactured to allow removal of some or all of the air bladder assembly for ease of cleaning and laundering and also may have ornamental designs, colors or fabrics. The brassiere of the invention may be modified by accomplishing the stiffening by stiffing the inner wall of the air-tight bag rather than stiffening the back of the bra. Any method for making the inside of the brassiere more stiff or less flexible then the outer side would be within the scope of the invention. In addition, if desired, the outside brassiere may be integrated with the air-tight bags.

Having now fully described this invention, it will be understood to those of ordinary skill in the art that the same can be performed within a wide and equivalent range of conditions, formulations, and other parameters without affecting the scope of the invention or any embodiment thereof.

What I claim is:

1. A brassiere for breast enhancement in women, said brassiere comprising:

a. a brassiere having two cups which are at least partially comprised of stretchable material, b. an air-tight bladder inserted into either one or both of said cups, said bladder comprising an inner layer lying adjacent to the skin surface of the wearer and an outer layer lying further away from said skin surface with the inner layer being stiffer than said outer layer, c. a pump which may be used to inflate or deflate the air bladder.

2. A brassiere for breast enhancement in women, said brassiere comprising:

a. a brassiere having two cups which are at least partially comprised of stretchable material, b. an air-tight bladder inserted into either one or both of said cups, c. an innermost layer that lies inwardly of said bladder and closer to the wearer's skin surface wherein said innermost layer is comprised of a stiff plate with a stiffness greater than said bladder, and d. a pump which may be used to inflate or deflate the air bladder.

3. The brassiere of claim 1 or 2 wherein, the pump is a ball pump.

4. The brassiere of claim 1 or 2 wherein said pump is situated between said cups and is capable of being operated by the wearer to adjust the quantity of air in either air-tight bladder while wearing the brassiere.

* * * * *